United States Patent [19]

Trombly

[11] Patent Number: 4,561,562

[45] Date of Patent: Dec. 31, 1985

[54] CONTAINER AND CLOSURE ASSEMBLY

[75] Inventor: Edgar F. Trombly, Grosse Pointe Farms, Mich.

[73] Assignee: Thermo-Serv, Inc., Anoka, Minn.

[21] Appl. No.: 609,642

[22] Filed: Aug. 6, 1984

Related U.S. Application Data

[63] Continuation of Ser. No. 457,691, Jan. 13, 1983, abandoned.

[51] Int. Cl.[4] ..... B65D 41/16

[52] U.S. Cl. ..... 220/306; 220/307

[58] Field of Search ..... 220/306, 307, 94 A

[56] References Cited

U.S. PATENT DOCUMENTS

| | | | |
|---|---|---|---|
| 2,984,382 | 5/1961 | Florsheim, Jr. | 220/306 |
| 3,023,926 | 3/1962 | Wilke | 220/306 |
| 3,139,131 | 6/1964 | Hutchinson | 220/306 |
| 3,556,338 | 1/1971 | Wilkson et al. | 220/306 |
| 3,679,088 | 7/1972 | Swett et al. | 220/306 |
| 4,380,304 | 4/1983 | Anderson | 220/306 |

FOREIGN PATENT DOCUMENTS

| | | | |
|---|---|---|---|
| 1181121 | 11/1964 | Fed. Rep. of Germany | 220/306 |
| 2907925 | 11/1978 | Fed. Rep. of Germany | 220/306 |
| 1215427 | 12/1970 | United Kingdom | 220/306 |
| 2035277 | 10/1979 | United Kingdom | 220/306 |

*Primary Examiner*—Joseph Man-Fu Moy

*Attorney, Agent, or Firm*—Kenneth J. Hovet

[57] ABSTRACT

A container is provided having a snap-on closure with an inner sealing flange. The container has a simple flared rim of uniform thickness and an underlying base ring for support. The closure sealingly engages the rim at the top and opposite sides thereof and includes an annular shoulder for supporting and positioning the base ring of a like container for stacking.

6 Claims, 7 Drawing Figures

CONTAINER AND CLOSURE ASSEMBLY

This is a continuation of application Ser. No. 457,691 filed 1/13/83, now abandoned.

BACKGROUND OF THE INVENTION

1. Field of the Invention

The present invention relates to container and closure combinations and, more particularly, to a container with a resealable closure that includes means for stacking.

2. Description of the Prior Art

Closures of the snap-on type that sealingly engage the rim portion of containers generally require the container rim to include various forms of bead or other interlocking configurations. In fact, except for U.S. Pat. No. 3,455,500, all the prior art of which applicant is aware includes a container rim structure that is enlarged or includes a flange or bead of some sort to provide for an effective engagement with a closure.

For example, prior art having an inner sealing member which is most pertinent to the present invention includes U.S. Pat. Nos. 3,335,774, 4,079,857, and 4,165,020. In each of these cases, the container rim includes an outwardly extending bead adapted to engage a corresponding area of the closure rim portion. Unquestionably, this creates problems and complications during molding of the container. It further can lead to an unattractive appearance. Also, the container rim bead can be nicked or damaged during use, thereby destroying the hermetic sealability of the closure.

The aforementioned U.S. Pat. No. 3,455,500 discloses a container rim portion which does not include a beaded or enlarged cross-sectional area. However, the cover attached thereto does not provide an effective sealing engagement. The inverted U-shape design of the closure is not intended to engage the container rim in a sealing manner. An inner rim flange is provided to scrape food stuffs from the inner container wall and a bead on the outer wall portion thereof is simply to provide a clamptype of engagement with the container flared rim.

SUMMARY OF THE INVENTION

The container and closure assembly of the present invention provides a rim sealing structure that is highly effective while being simpler in construction than the prior art. The container rim portion is of uniform thickness substantially throughout its longitudinal extent and flares outwardly for simplicity in design and molding. The closure has an inverted U-shaped rim structure that includes an inner sealing ring and an opposing bead. The bead and ring coact to resiliently and sealingly engage the container rim portion. The bead also exerts an upwardly directed force that urges the top edge of the container rim into sealing contact with the underside of the closure rim. As above described, multiple contacts are made between the closure and container rim structures to positively insure an effective seal.

The closure further includes a concentric annular shoulder portion. The shoulder portion is adapted to locate and support the container base ring so that a series of like containers may be stacked upon each other in a stable manner.

DESCRIPTION OF THE PREFERRED EMBODIMENTS

Figure 1:
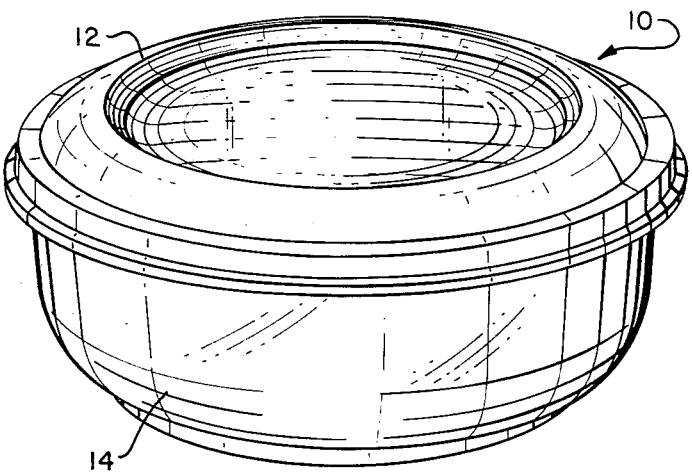
FIG. 1 is a perspective view of the container and closure assembly of the present invention.
Figure 4:
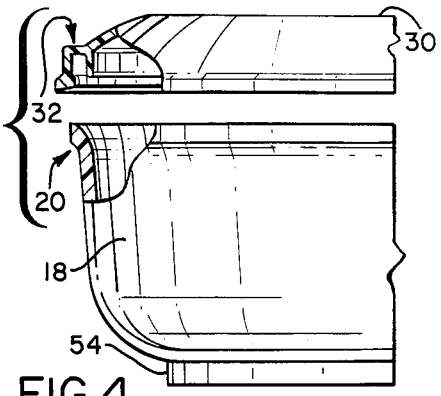
FIG. 4 is an exploded fragmentary side elevation view with a broken-away cross-section view of the container and closure rim structures of the invention shown in FIG. 1.
Figure 5:
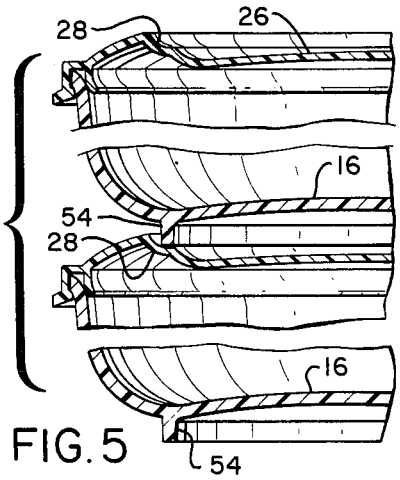
FIG. 5 is fragmentary cross-sectional side elevation view showing stacking of like container and closure assemblies upon each other.
Figure 2:
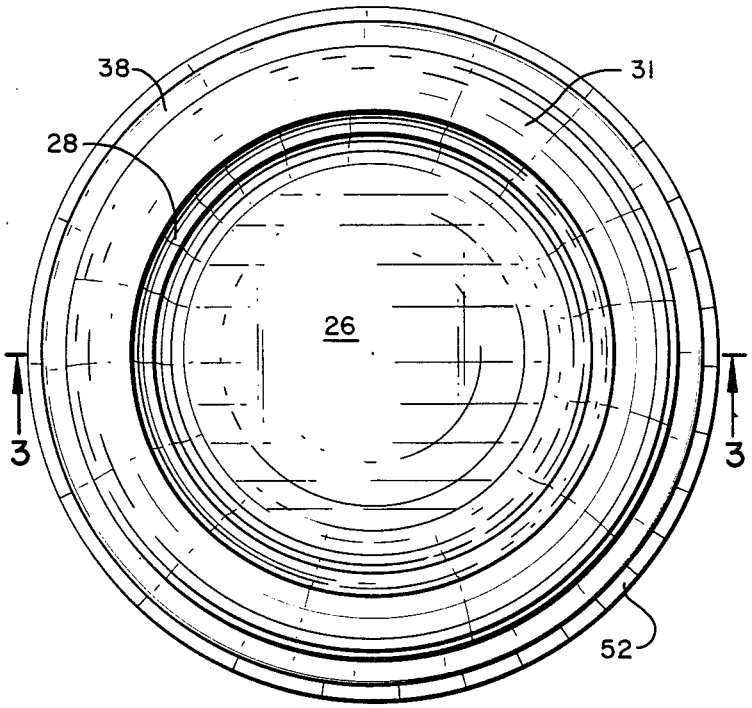
FIG. 2 is a top plan view of the assembly shown in FIG. 1.

With reference now to the drawings, the container and closure assembly (10) will be described. The container (14) is generally bowl-shaped having a base (16) connected to an upwardly extending annular wall (18). The wall terminates in an outwardly flared rim (20) which defines the opening of the container. The uppermost point of the rim comprises an annular top edge sealing surface (24) that is preferably flat. Extending vertically downward from the top edge is an outer face (22). The face is preferably smooth and ring-like in shape.

Figure 3:
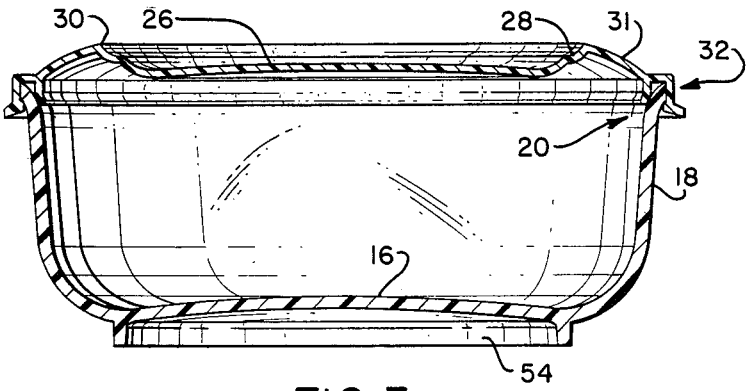
FIG. 3 is a cross-sectional view taken along lines 3—3 of FIG. 2.

A feature of the invention is the wall thickness of at least the container rim (20). Except for uppermost surface (24), it is the same substantially. As shown in FIG. 3, the annular wall (18) and base (16) are also uniform in thickness throughout their longitudinal extent.

The container base is provided with a support ring (54) that extends downwardly from the base underside. For purposes to be hereinafter described, the ring is concentric with the center axis of the bowl.

The container closure (12) is preferrably round and overlies the container opening. It includes a center portion (26) that merges into a concentric upraised annular shoulder (28). Extending radially outward and upward from the shoulder is ridge (30). Connecting the ridge to the inverted U-shaped peripheral rim structure (32) is an annular top wall region shown by reference numeral (31). The peripheral rim structure is adapted to sealingly engage and hermetically seal with the entire container rim structure in a manner to be hereinafter described.

The rim structure (32) comprises a downwardly extending inner sealing ring (34) having a deflectible free end (36). Extending transversely outward from the base of the ring is web (38). Extending downwardly from the web is outer rim wall (40).

At the lower end of the rim wall is an inwardly directly bead (42) and an outwardly extending skirt portion (52). The bead includes an upwardly inclined surface (48) which terminates at its lowest point at bead innermost edge (50).

The rim wall has an inside face (46) having a vertical extent at least equal to, and preferrably slightly greater than, the vertical outer face (22) of the container rim.

Web (38) is also provided with an underside having a planar surface corresponding to the flat container top edge (24).

The innermost edge and sealing ring free end (36) are spaced apart by the web (38) a distance less than the thickness of the container rim (20). In this manner, the rim will be securely engaged therebetween by the compressive forces of the resilient plastic material comprising the closure rim structure. As such, a strong highly effective double seal is created.

The aforementioned innermost edge (50) is vertically below the free end (36) of the sealing ring. With such disposition and the resilience of the rim wall pushing edge (50) against the curved outer surface of the flared rim, an upward force will result causing a positive seal between the top edge (24) and web underside (44).

Figure 6:
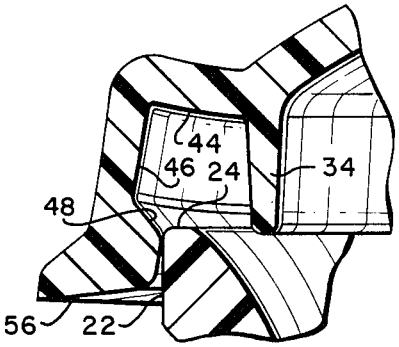
FIG. 6 is an enlarged fragmentary cross-section view of the closure rim and container rim during placement of the closure on the container rim.
Figure 7:
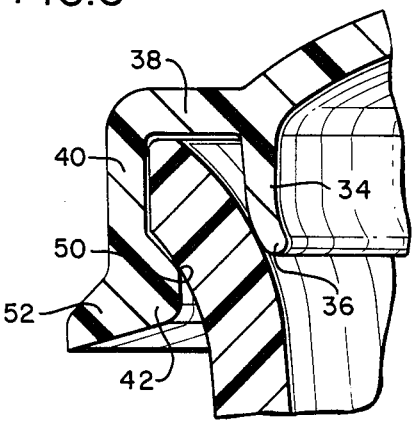
FIG. 7 is an enlarged fragmentary cross-section view of the closure in sealing engagement with the container rim.

Connecting the closure (12) to the container (14) can best be described with reference to FIGS. 6 and 7. The closure is placed loosely over the container opening and one may grasp the skirt underside, shown by reference numeral (56), and pull upwardly and outwardly while simultaneously pressing downwardly upon web (38). Such action will allow the bead (42) to slip over face (22) and engage the underside of the flared rim with innermost edge (50). Simultaneous with the above distortion will be the deflection of sealing ring free end (36) against the inner wall of container rim (20).

After the aforementioned engagement at a portion of the rim structure, one may progressively apply force to the top of web (38) about the remaining periphery of the rim structure. This will result in the aforementioned distortion and allow complete engagement of the closure to the container with the concomitant formation of at least a triple seal. Such seal exists between the outer surface of the flared rim and innermost edge (50). It further exists between the top edge face (24) and web underside (44). It also occurs between the inner surface of the flared rim and the outer surface of deflectible free end (36). Still further, it may also exist about the opposing faces of the rim wall (46) and flared rim face (22).

As mentioned hereinabove, the container base includes a support ring (54) and the closure includes an annular shoulder (28). Both of the above structures are positioned concentric to the center axis of the assembly and the circular diameter of each are constructed to be about equal. In this manner, ring (54) will rest upon shoulder (28) so that several like containers can be stacked upon each other. Further, due to the upraised ridge (30), the ring structure will not be readily dislodged from its place on shoulder (28).

In preferred embodiments of the invention, the container and closure assembly are constructed of resilient plastic and are round or oval in shape. In this regard, it will be noted that the base (16) is convex in cross-section as is the closure center portion (26). Such configuration allows for an enhanced resilience and encourages an effective seal between the closure and container. Further, having the center portion (26) convex in shape and by having the annular to wall region in the shape of a truncated dome, one can readily depress the closure during insertion upon the container rim and expel air during the closing procedure. This action further enhances an air tight seal by creating a slight vacuum therein.

While the invention has been described with respect to preferred embodiments, it will be apparent to those skilled in the art that other modifications may be made without departing from the scope and spirit of the invention. As such, it will be understood that the invention is not to be limited by the aforementioned specific embodiments but only by the scope of the appended claims.

I claim:

1. A container and closure assembly wherein said container comprises:

a base connected to an upwardly extending annular wall that terminates at an outwardly flared rim defining the opening of the container, said rim having a uniform wall thickness substantially throughout its longitudinal extent with an outer face and a top edge sealing surface;

said closure overlying the container opening and comprising:

a center portion merging into an upraised annular shoulder which extends radially outward and upward to a ridge, an annular top wall region in the shape of a truncated dome connecting the ridge to a peripheral rim structure;

said rim structure sealingly engaged to the flared rim of said container comprising a downwardly extending inner sealing ring having a deflectible free end, a flexible transversely extending web connecting the ring to an outer downwardly extending rim wall having at its lower end an inwardly directed bead, said bead having an inner surface that inclines upwardly to the inside face of the rim wall, said inner surface extending downwardly and outwardly from said innermost edge to define a skirt portion at the base of said rim wall, said bead and free end being spaced-apart by the web a distance less than the thickness of said container rim engaged therebetween, the underside of said web having an annular surface corresponding to the container top edge surface for sealing engagement therewith.

2. The assembly of claim 1 wherein said innermost edge is vertically below the free end of said sealing ring.

3. The assembly of claim 1 wherein said base includes a downwardly extending support ring concentric with said shoulder and having a diameter about equal thereto.

4. The assembly of claim 3 wherein said closure top wall center portion is convex.

5. The assembly of claim 3 wherein said base is convex and the annular wall of said shoulder inclines outwardly.

6. The assembly of claim 1 wherein the outer face of said container rim has a vertically disposed surface corresponding to the vertical surface of said closure rim wall inside face.

* * * * *